US006055409A

United States Patent [19]

Richards et al.

[11] Patent Number: 6,055,409

[45] Date of Patent: Apr. 25, 2000

[54] SHEET PRE-TRANSFER DEVICE

[75] Inventors: Paul N. Richards, Fairport; Christian O. Abreu, Rochester, both of N.Y.; Randolph Cruz, Palm Bay, Fla.; David M. Attridge, Rochester, N.Y.

[73] Assignee: Xerox Corporation, Stamford, Conn.

[21] Appl. No.: 09/216,148

[22] Filed: Dec. 18, 1998

[51] Int. Cl.[7] ..... G03G 15/00; B65H 9/16

[52] U.S. Cl. ..... 399/388; 271/251

[58] Field of Search ..... 271/10.11, 10.12, 271/10.13, 10.15, 10.16, 225, 226, 264, 267, 251; 399/381, 388, 389, 390, 391, 394, 395

[56] References Cited

U.S. PATENT DOCUMENTS 4,938,468 7/1990 Wafler ..... 271/272
5,156,392 10/1992 Wong et al. ..... 271/251
5,311,267 5/1994 Bean ..... 399/361
5,697,608 12/1997 Castelli et al. ..... 271/228

*Primary Examiner*—Arthur T. Grimley
*Assistant Examiner*—Hoang Ngo
*Attorney, Agent, or Firm*—Kevin R. Kepner

[57] ABSTRACT

A pretransfer sheet feeding device for an electrophotographic printing machine that minimizes impact with and delivers a sheet to a photoreceptor at a desired tangential position. The sheet feeding device includes a selectively engageable drive nip and a biased baffle member which forms a buckle chamber. There is further a plurality of rollers located so as to provide substantially frictionless directional guidance to the sheet while also inducing a predetermined bend to the sheet so as to deliver the sheet to the photoreceptor. The pretransfer rollers are also moveable so that the angle of approach of a sheet can be adjusted based on sheet weight or other characteristics. Once the sheet is tacked to the photoreceptor in the transfer zone, the disengageable drive nip is released and the sheet is controlled by the photoreceptor so that speed mismatch is not a problem.

13 Claims, 3 Drawing Sheets

SHEET PRE-TRANSFER DEVICE

This invention relates generally to a sheet guide and driving apparatus and more particularly, concerns a pretransfer device to guide a sheet to a transfer zone on a photoreceptive member while causing a minimal disturbing force to the photoreceptor by the sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color.

In single pass color machines it is desirable to cause as little disturbance to the photoreceptor as possible so that motion errors are not propagated along the belt to cause image quality and color separation registration problems. One area that has potential to cause such a disturbance is when a sheet is brought into contact with the photoreceptor for transfer of the developed image thereto. Particularly in machines which handle a large range of paper weights and sizes it is difficult to have a sheet guide which can properly position any weight and size sheet while not causing the sheet to come into abrupt hard contact with the photoreceptor.

It is therefore desirable to have a pretransfer sheet guide that can handle a wide variety of sheet weights and sizes while maintaining the capability to align and deliver the sheet to the photoreceptor with as little impact as possible.

In accordance with one aspect of the present invention, there is provided a sheet feeding device for moving a sheet along a path, comprising a first drive nip and a substantially frictionless baffle adjacent said first drive nip, said baffle further including a buckle chamber and a plurality of substantially frictionless guide members to induce a predetermined bend to a sheet and to deliver the sheet at a predetermined point at a specific alignment.

In accordance with another aspect of the invention there is provided an electrophotographic printing machine having a photoreceptive member and including a pretransfer sheet feeding apparatus. The sheet feeding apparatus comprising a first drive nip and a substantially frictionless baffle adjacent said first drive nip, said baffle further including a buckle chamber and a plurality of substantially frictionless guide members to induce a predetermined bend to a sheet and to deliver the sheet at a predetermined point and at a specific alignment to the photoreceptive member.

Other features of the present invention will become apparent as the following description proceeds and upon reference to the drawings, in which.

This invention relates to printing system which is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multi-pass color process system, a single or multiple pass highlight color system and a black and white printing system.

Figure 1:
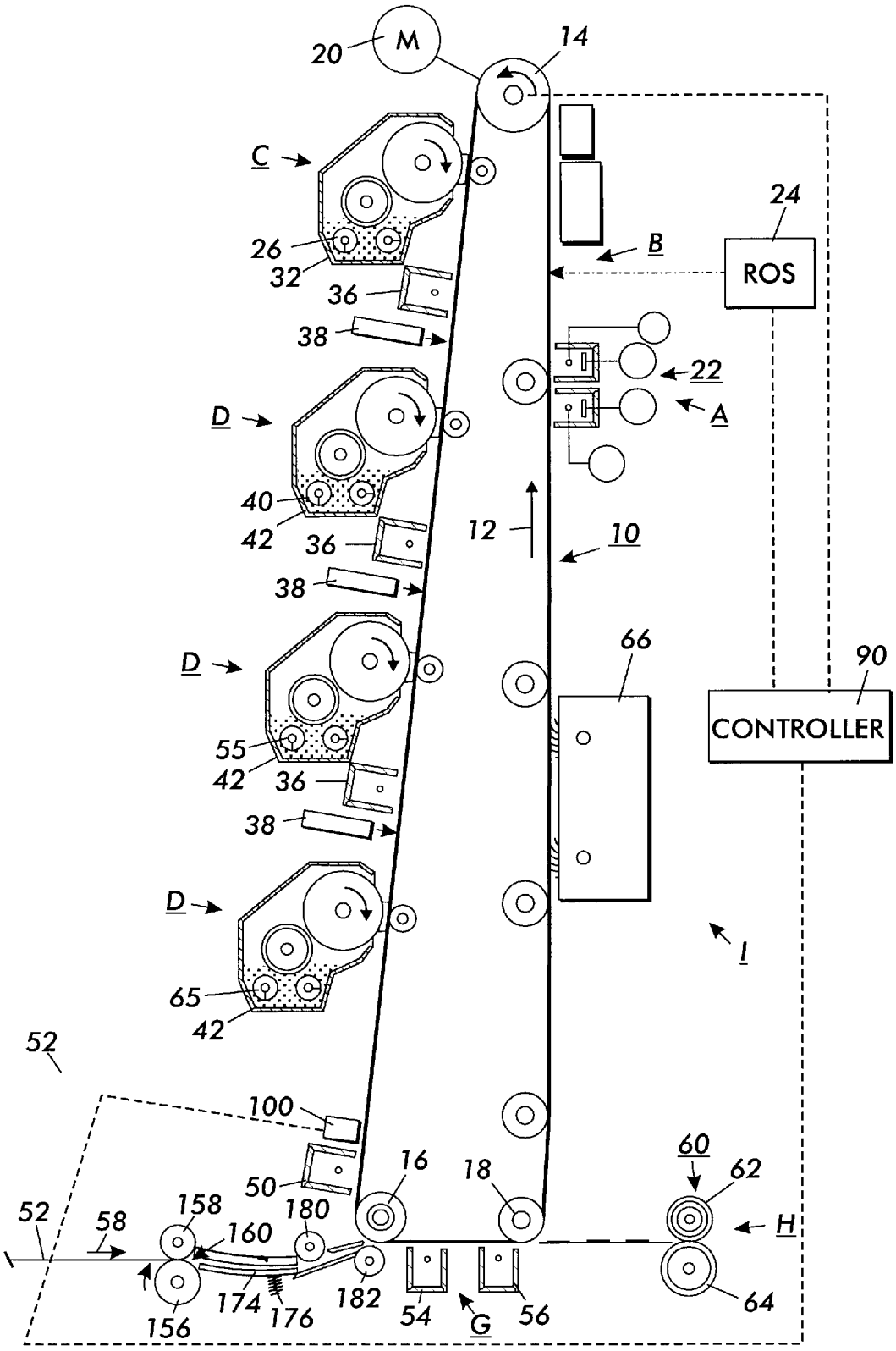
FIG. 1 is a schematic elevational view of a full color image-on-image single-pass electrophotographic printing machine utilizing the device described herein.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and tension and steering rollers 16 and 18 respectively, roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{image}$ equal to about −50 volts. Thus after exposure, the photoreceptor contains a monopolar voltage profile of high and low voltages, the former corresponding to charged areas and the latter corresponding to discharged or image areas.

At a first development station C, developer structure, indicated generally by the reference numeral 32 utilizing a hybrid jumping development (HJD) system, the development roll, better known as the donor roll, is powered by two development fields (potentials across an air gap). The first field is the AC jumping field which is used for toner cloud generation. The second field is the DC development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor and previously developed toner image areas are recharged to a predetermined level.

A second exposure/imaging is performed by imaging device 38 which comprises a laser based output structure and is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by a sheet feeding apparatus to the pretransfer device of the present invention which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
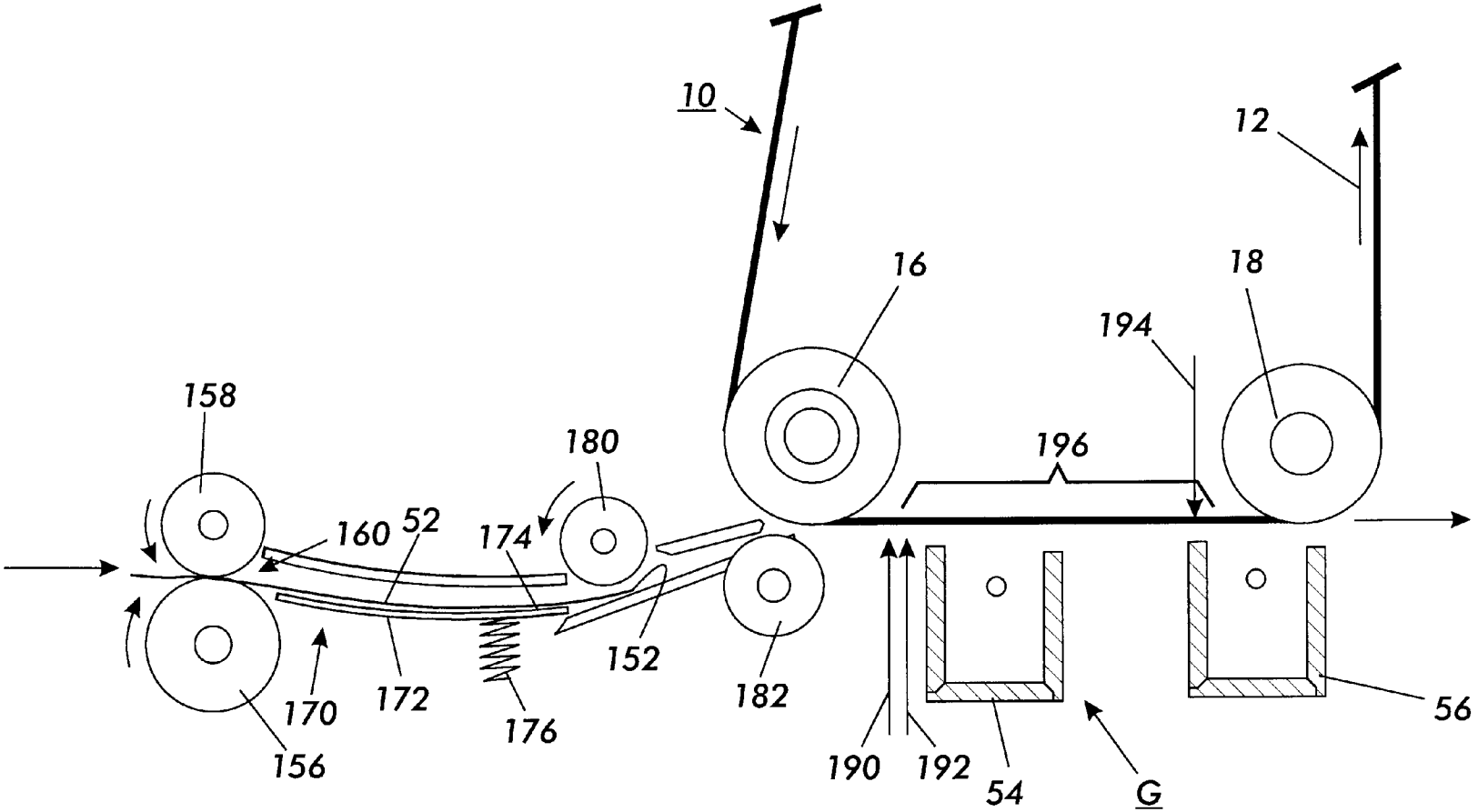
FIG. 2 is a side view illustrating the pretransfer device relative to the FIG. 1 printing machine.
Figure 3:
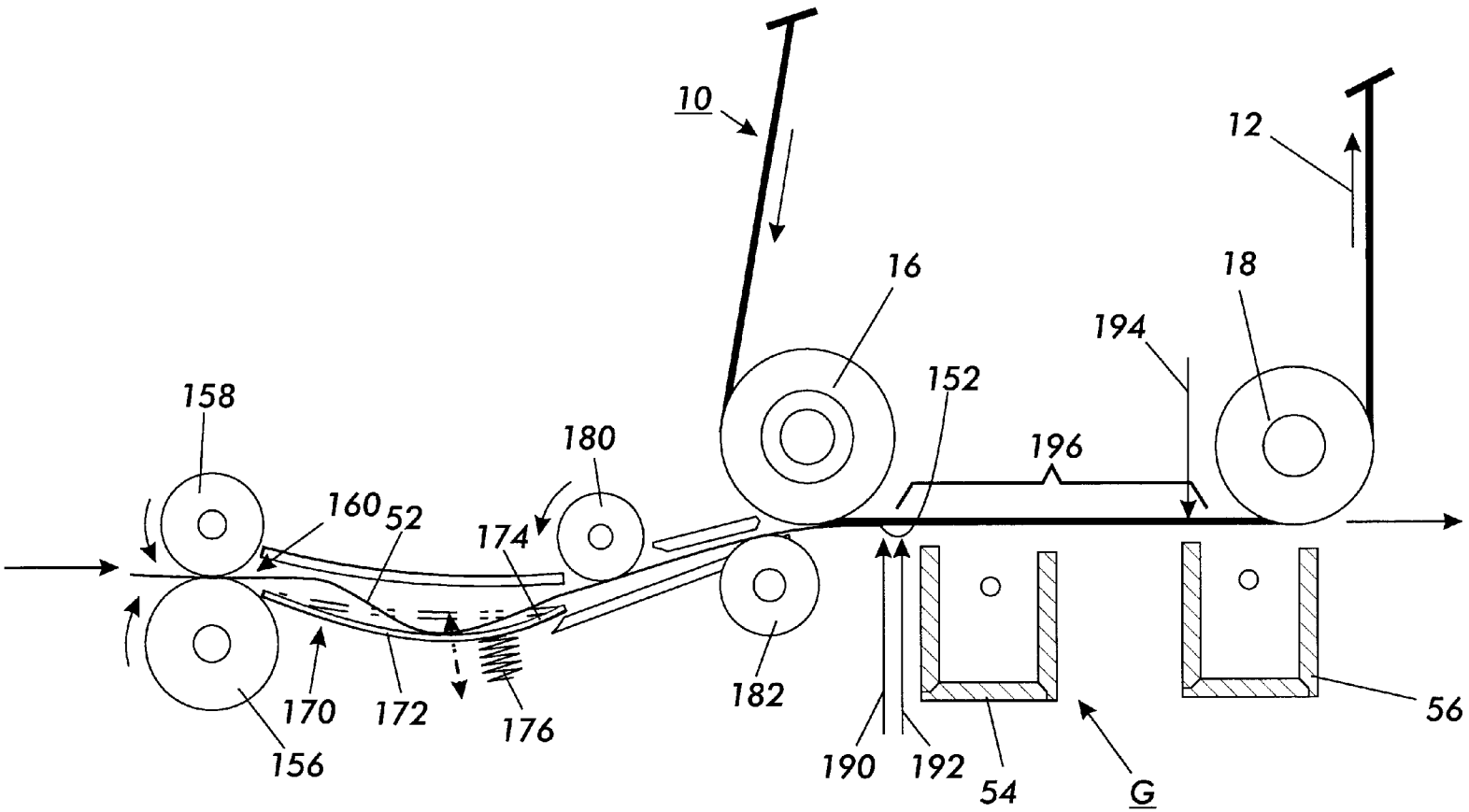
FIG. 3 is a side view illustrating the pretransfer device buckle chamber relative to the FIG. 1 printing machine.

As shown in FIG. 2, the device transport/transitions a sheet with precision to the photoreceptor belt. It minimizes variations in impact and tangency contact locations prior/during transfer and yet is flexible enough to allow sheet storage at minimal drive and contact forces. The low contact forces eliminate sheet marking on sensitive paper substrates. It also accurately controls sheet placement during conditions of extreme curl (nominally +/−100 mm radii for 34 gsm weight and +/−250 mm radii for 271 gsm weight paper) with consistent photoreceptor (P/R) belt contacts and tangencies.

The lead edge 152 of the paper 52 exits nip 160 formed by rolls 158 and 156, and enters the lower pre transfer baffle area 170 (see FIG. 2). This area 170, provides a buckling chamber 172 to store paper during sheet transfer to the photoreceptor 10. This is required because of potential mismatch between registration transport (not shown) velocity and P/R belt 10 velocity and tangency variations due to variables such as paper curl and basis weight variations. The lower baffle 174 of the chamber may be spring loaded by spring 176 or otherwise biased to provide additional sheet storage for heavy and stiffer paper. This will also reduce the drive force required.

The sheet continues its motion to rolls 180 and 182, where sheet contact is made on each roll. The two rolls provide tight control of the sheet and minimize the sheet variations during initial and tangential photoreceptor contact. During conditions of sheet up/down curl, rolls 180 and 182 induce reverse stress on the sheet allowing for accurate placement of the sheet lead edge 152 on the photoreceptor 10.

The sheet 52 continues its motion until the sheet contacts the photoreceptor 10. At this point the gap between roll 182 and contact point 190, serves as a gate or control point. At contact point 190, the sheet angle should be greater than 15° but less than 25°. This angle is achieved to reduce sheet contact forces with the photoreceptor 10. Roll 182 may also be spring loaded or otherwise biased to reduce the stress induced on heavier and stiffer paper when it attempts to bend and tack against the P/R belt 10.

The sheet 52 continues until sheet tangency point 192 occurs on the photoreceptor belt 10. The sheet continues to be driven by nip 160 until the sheet lead edge 152 reaches point 194 on the P/R belt 10. At this point, nip 160 is released and the P/R belt pulls the sheet 52 through the pretransfer device. Point 194 is chosen so as to achieve enough sheet area under the transfer zone 196 where there is sufficient transfer/detack electrostatic pressure (normal force) to cause the sheet 52 to adhere to the belt 10. However, the paper path length between nip 160 and point 194 has to be no larger than the length of the smallest sheet length to be fed.

A result of the pretransfer device is that rollers 180 and 182 (which can be driven or idlers) impart a "reverse" stress to the sheet to act as a passive "decurler". This dramatically minimizes the variability of the paper contact points on the photoreceptor. This is highly critical to a printer which has very tight specifications for matching the paper lead edge position to a specific point on the photoreceptor.

This invention virtually eliminates the stalling problem of high stiffness paper at high contact angles by adding driven rollers at the high paper friction points. Now both high and low stiffness paper can be run at the same contact angle without stalling (paper contact angle on P/R belt 10 preferably less than 20°).

The two passive/active rolls 180, 182 are strategically located to impart a "reverse" stress to the sheet 52 to act as a passive "decurler" (no moving parts). This dramatically minimizes the variability of the paper contact points on the photoreceptor.

The rollers provide stability to the sheet prior to it entering the transfer zone and thus reducing the chances of paper smear, etc. (no paper disturbance upstream) and they provide only two contact points (tangent to the rolls) with the paper which also minimizes the drag force and thus required drive force as opposed to baffles that would provide an inconsistent number of contact points and a higher drag force on the paper. Additionally, the rollers are adjustable so that the angle of approach of a shet to the photoreceptor can be varied dependent on sheet characteristics, particularly with respect to sheet weight. Thus, the pretransfer device is further able to deliver the various weight sheets to the photoreceptor with a minimal impact.

The buckling chamber 172 may be spring loaded or otherwise biased to serve as a self-adjusting baffle for paper stiffness in order to enhance performance. For heavier paper will deflect the baffle to a greater extent than light paper thereby enabling a self adjusting baffle chamber.

In recapitulation, there is provided a pretransfer sheet feeding device for an electrophotographic printing machine that minimizes impact with and delivers a sheet to a photoreceptor at a desired tangential position. The sheet feeding device includes a selectively engageable drive nip and a biased baffle member which forms a buckle chamber. There is further a plurality of rollers located so as to provide substantially frictionless directional guidance to the sheet while also inducing a predetermined bend to the sheet so as to deliver the sheet to the photoreceptor. Once the sheet is tacked to the photoreceptor in the transfer zone, the disengageable drive nip is released and the sheet is controlled by the photoreceptor so that speed mismatch is not a problem.

It is, therefore, apparent that there has been provided in accordance with the present invention, a pretransfer sheet feeding apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet feeding device for moving a sheet along a path, comprising:

a drive nip;

a substantially frictionless baffle adjacent said drive nip, said baffle further including a buckle chamber and a plurality of substantially frictionless guide members to induce a predetermined bend to a sheet and to deliver the sheet at a predetermined point at a specific alignment.

2. A device according to claim 1, wherein said plurality of substantially frictionless guide members comprise a plurality of rollers, with at least one of said plurality of rollers contacting the sheet on a first side and at least a second one of said plurality of rollers contacting the sheet on the opposite side of the sheet.

3. A device according to claim 2, wherein said plurality of rollers are driven so that the sheet is positively driven through said baffle by said plurality of rollers.

4. A device according to claim 2, wherein said plurality of rollers are idlers so that the sheet is positively driven through said baffle by said drive nip.

5. A sheet feeding device for moving a sheet along a path, comprising:

a drive nip;

a substantially frictionless baffle adjacent said drive nip, said baffle further including a buckle chamber and a plurality of substantially frictionless guide members to induce a predetermined bend to a sheet and to deliver the sheet at a predetermined point at a specific alignment, wherein said buckle chamber comprises a moveable guide member located downstream in the path from said first drive nip and prior to said substantially frictionless guide members, said guide member being moveable when contacted by a sheet and a biasing member, attached to said moveable guide member, said biasing member providing resistance to movement of said guide member when said guide member is contacted by a sheet.

6. A device according to claim 1, wherein said drive nip is selectively disengageable so that the sheet can be released when a predetermined position has been achieved.

7. An electrophotographic printing machine having a photoreceptive member and including a pretransfer sheet feeding apparatus, comprising:

a drive nip;

a substantially frictionless baffle adjacent said drive nip, said baffle further including a buckle chamber and a plurality of substantially frictionless guide members to induce a predetermined bend to a sheet and to deliver the sheet at a predetermined point and at a specific alignment to the photoreceptive member.

8. A printing machine according to claim 7, wherein said plurality of substantially frictionless guide members comprise a plurality of rollers, with at least one of said plurality of rollers contacting the sheet on a first side and at least a second one of said plurality of rollers contacting the sheet on the opposite side of the sheet.

9. A printing machine according to claim 8, wherein said plurality of rollers are driven so that the sheet is positively driven through said baffle by said plurality of rollers.

10. A printing mace according to claim 8, wherein said plurality of rollers are idlers so that the sheet is positively driven through said baffle by said drive nip.

11. An electrophotographic printing machine having a photoreceptive member and including a pretransfer sheet feeding apparatus, comprising:

a drive nip;

a substantially frictionless baffle adjacent said drive nip, said baffle further including a buckle chamber and a plurality of substantially frictionless guide members to induce a predetermined bend to a sheet and to deliver the sheet at a predetermined point and at a specific alignment to the photoreceptive member, wherein said buckle chamber comprises a moveable guide member located downstream in the path from said drive nip and prior to said substantially frictionless guide members, said guide member being moveable when contacted by a sheet and a biasing member, attached to said moveable guide member, said biasing member providing resistance to movement of said guide member when said guide member is contacted by a sheet.

12. A printing machine according to claim 7, wherein said drive nip is selectively disengageable so that the sheet can be released when the sheet has been delivered to a predetermined position on the photoreceptive member.

13. A printing machine according to claim 7, wherein said substantially frictionless baffle is adjustable so that the angle of a sheet being fed to the photoreceptive member is adjustable.

* * * * *